US010883755B2

(12) United States Patent
Oh

(10) Patent No.: US 10,883,755 B2
(45) Date of Patent: Jan. 5, 2021

(54) REFRIGERATOR

(71) Applicant: LG ELECTRONICS INC., Seoul (KR)

(72) Inventor: Minkyu Oh, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 109 days.

(21) Appl. No.: 16/201,574

(22) Filed: Nov. 27, 2018

(65) Prior Publication Data

US 2019/0186806 A1 Jun. 20, 2019

(30) Foreign Application Priority Data

Dec. 19, 2017 (KR) ..... 10-2017-0175034

(51) Int. Cl.
*F25D 17/06* (2006.01)
*F25D 17/08* (2006.01)
(Continued)

(52) U.S. Cl.
CPC ..... *F25D 17/065* (2013.01); *F25B 21/02* (2013.01); *F25B 49/00* (2013.01); *F25D 17/045* (2013.01);
(Continued)

(58) Field of Classification Search
CPC ..... F25D 17/065; F25D 17/045; F25D 17/08; F25D 29/005; F25D 29/0671;
(Continued)

(56) References Cited

U.S. PATENT DOCUMENTS 2,932,953 A * 4/1960 Becket ..... F25B 21/02 62/3.6
5,884,486 A * 3/1999 Hughes ..... F25B 21/02 62/279
(Continued)

FOREIGN PATENT DOCUMENTS

EP 1821051 A1 8/2007
GB 1261610 1/1972
(Continued)

*Primary Examiner* — Kun Kai Ma
(74) *Attorney, Agent, or Firm* — Dentons US LLP

(57) ABSTRACT

A refrigerator includes a main body that includes an inner case having a storage chamber; a refrigerating chamber discharge duct that divides the storage chamber into a heat exchange chamber and a refrigerating chamber and has refrigerating chamber discharge ports for discharging cold air to the refrigerating chamber. A refrigerating chamber thermoelectric module has a first heat absorbing unit and a first heat dissipating unit, the first heat absorbing unit disposed in the heat exchange chamber. A refrigerating chamber cooling fan circulates cold air in the refrigerating chamber to the heat exchange chamber and the refrigerating chamber; and a refrigerating chamber heat dissipating fan blows external air to the first heat dissipating unit A freezing compartment is disposed in the refrigerating chamber and has a freezing chamber; a freezing compartment thermoelectric module has a second heat absorbing unit and a second heat dissipating unit, the second heating dissipating unit cooling the freezing chamber. An air guide has a channel for guiding cold air from the heat exchange chamber to the second heat dissipating unit; and a freezing compartment damper controls the cold air flowing toward the second heat dissipating unit through the channel.

18 Claims, 9 Drawing Sheets

(51) Int. Cl.
*F25D 29/00* (2006.01)
*F25D 17/04* (2006.01)
*F25B 49/00* (2006.01)
*F25B 21/02* (2006.01)

(52) U.S. Cl.
CPC ..... *F25D 17/08* (2013.01); *F25D 29/005* (2013.01); *F25B 2321/023* (2013.01); *F25B 2321/0211* (2013.01); *F25D 2317/061* (2013.01); *F25D 2317/063* (2013.01); *F25D 2317/0665* (2013.01); *F25D 2317/0666* (2013.01); *F25D 2317/0667* (2013.01); *F25D 2317/0671* (2013.01); *F25D 2317/0672* (2013.01); *F25D 2317/0682* (2013.01); *F25D 2700/121* (2013.01); *F25D 2700/122* (2013.01)

(58) Field of Classification Search
CPC .. F25D 29/061; F25D 29/063; F25D 29/0667; F25D 2700/122; F25D 2700/121; F25D 2317/0666; F25D 2317/0672; F25D 2317/0665; F25B 49/00; F25B 21/02; F25B 2321/023; F25B 2321/0211
See application file for complete search history.

(56) References Cited

U.S. PATENT DOCUMENTS 6,003,319 A * 12/1999 Gilley ..... F28F 1/128 62/3.7
6,278,098 B1 * 8/2001 Han ..... F25D 23/12 126/21 A
6,463,743 B1 * 10/2002 Laliberte ..... F25B 21/04 62/3.3
2002/0121095 A1 * 9/2002 Adamski ..... F25D 19/00 62/3.6
2004/0025515 A1 * 2/2004 Evans ..... G11B 33/142 62/3.2
2006/0144073 A1 * 7/2006 Lee ..... F25D 11/02 62/333
2007/0101602 A1 * 5/2007 Bae ..... D06F 58/206 34/77
2010/0126200 A1 * 5/2010 Oh ..... F25D 17/065 62/335
2012/0174607 A1 7/2012 Cur et al.
2012/0186272 A1 * 7/2012 Son ..... F25D 11/00 62/3.3
2012/0304667 A1 * 12/2012 Shin ..... F25D 11/025 62/3.6
2012/0312030 A1 * 12/2012 Lu ..... F25B 21/02 62/3.6
2013/0276465 A1 * 10/2013 Shin ..... F25D 11/00 62/3.6
2014/0245771 A1 * 9/2014 Kim ..... B01J 23/72 62/264
2015/0075184 A1 * 3/2015 Edwards ..... F28D 15/0266 62/3.2
2019/0162453 A1 * 5/2019 Oh ..... F25D 31/005
2020/0056828 A1 * 2/2020 Kim ..... F25D 23/10

FOREIGN PATENT DOCUMENTS

JP 2000329442 A 11/2000
KR 10-1993-0023676 A 12/1993
KR 20020082944 A * 11/2002 ..... F25D 11/02
KR 1020040016659 2/2004
KR 10-0483919 B1 4/2005

* cited by examiner

REFRIGERATOR

CROSS REFERENCE TO RELATED APPLICATION

The present application claims priority to Korean Patent Application No. 2017-01 filed on Dec. 19, 2017, the entire contents of which is incorporated herein for all purposes by this reference, under Articles 119(35) and 365(35) of U.S. Patent Law.

BACKGROUND

Field of the Disclosure

The present disclosure relates to a refrigerator and, more particularly, to a refrigerator of which storage chambers are cooled by a thermoelectric module.

Background

A refrigerator is an apparatus that prevents food from rotting and spoiling and preserves medicine or cosmetic by keeping them cool.

A refrigerator includes a storage chamber for keeping food, medicine, or cosmetic, and a cooling device for cooling the storage chamber.

The cooling device, for example, may be a refrigeration cycle device including a compressor, a condenser, an expansion unit, and an evaporator.

Alternatively, the cooling device, for example, may be a thermoelectric module (TEM) that uses a phenomenon in which a temperature difference is generated at both cross-sections of different metals coupled to each other when current is applied to the metals.

The refrigeration cycle device has a problem in that, while efficiency is high, loud noise is generated when the compressor is driven, as compared with the thermoelectric module.

However, the thermoelectric module, when compared with the refrigeration cycle device, is low in efficiency, but has the advantage of less noise and can be used for small refrigerators, etc.

An example of a refrigerator designed such that a thermoelectric module cools the inside of the refrigerator has been disclosed in Korean Patent Application Publication No. 19930023676 A (published on Dec. 21, 1993). This refrigerator includes a refrigerator body formed by insulating walls, a thermoelectric element using an inner side of the refrigerator as a heat-absorbing surface and an outer side of the refrigerator as a heat-dissipating surface, an inner conductive block disposed to be able to transmit heat to the heat-absorbing surface of the thermoelectric element, an internal heat exchanger disposed to transmit heat by heat exchange with air inside the refrigerator to the inner conductive block, and an external heat exchanger accelerating heat dissipation of the thermoelectric element, in which the internal heat exchanger cools one storage chamber.

Meanwhile, a refrigerator may have a temperature controlled chamber, which is cooled colder than a storage chamber, in the storage chamber, and may cool the temperature controlled chamber with a thermoelectric module.

An example of a refrigerator in which a thermoelectric module cools a temperature control chamber has been disclosed in Korean Patent No. 10-0483919 B1 (published on Apr. 18, 2005). According to this refrigerator, a compressor, an evaporator, and a blowing fan are disposed at an upper portion in the refrigerator and maintain a refrigerating chamber at a refrigeration temperature. Further, the thermoelectric module is disposed behind the temperature controlled chamber defined in the refrigerating chamber. Further, cold air blown to the refrigerating chamber by the blowing fan increases in temperature while passing through the refrigerating chamber, flows to a heat dissipating member of the thermoelectric element, and then flows to the evaporator through a guide duct.

However, according to the refrigerator disclosed in Korean Patent No. 10-0483919 B1 (published on Apr. 18, 2005), a compressor and an evaporator are installed to cool the refrigerating chamber, so loud noise is generated. Further, the cold air that increases in temperature while cooling the refrigerating chamber removes heat of the heat dissipating member of the thermoelectric module, so there is a limit as to reducing the temperature of a heat absorbing unit of the thermoelectric module.

SUMMARY

An object of the present disclosure is to provide a refrigerator that may maximally reduce the temperature range of a freezing chamber and may minimize noise.

A refrigerator according to an embodiment of the present invention includes: a main body that includes an inner case having a storage chamber; a refrigerating chamber discharge duct that divides the storage chamber into a heat exchange chamber and a refrigerating chamber and has refrigerating chamber discharge ports for discharging cold air to the refrigerating chamber; a refrigerating chamber thermoelectric module that has a first heat absorbing unit and a first heat dissipating unit, the first heat absorbing unit being disposed in the heat exchange chamber to cool the refrigerating chamber; a refrigerating chamber cooling fan that circulates cold air in the refrigerating chamber to the heat exchange chamber and the refrigerating chamber; a refrigerating chamber heat dissipating fan that blows external air to the first heat dissipating unit; a freezing compartment that is disposed in the refrigerating chamber and a has a freezing chamber; a freezing compartment thermoelectric module that has a second heat absorbing unit and a second heat dissipating unit, the second heating dissipating unit cooling the freezing chamber; an air guide that has a channel for guiding cold air from the heat exchange chamber to the second heat dissipating unit; and a freezing compartment damper that controls air flowing toward the second heat dissipating unit through the channel.

The air guide may be disposed over the refrigerating chamber discharge duct.

The air guide may have an expanding portion disposed between the upper end of the refrigerating chamber discharge duct and the second heat dissipating unit.

The freezing compartment thermoelectric module may be smaller in size than the refrigerating chamber thermoelectric module.

The second heat absorbing unit may be disposed in the freezing compartment, and the second heat dissipating unit may be disposed between the freezing compartment and the inner case.

The refrigerator may further include a freezing compartment damper that controls air flowing to the second heat dissipating unit through the channel.

The refrigerator may further include: a freezing chamber cooling fan that circulates air in the freezing chamber to the second heat absorbing unit and the freezing chamber; and a freezing chamber heat dissipating fan that blows cold air from the heat exchange chamber to the second heat dissipating unit.

The refrigerator may further include a controller that controls the refrigerating chamber thermoelectric module, the freezing compartment thermoelectric module, the refrigerating chamber cooling fan, the refrigerating chamber heat dissipating fan, the freezing compartment damper, the freezing chamber cooling fan, and the freezing chamber heat dissipating fan.

The controller may apply low voltage to at least one of the refrigerating chamber thermoelectric module and the freezing compartment thermoelectric module when the freezing compartment is in a high-temperature cooling mode. The controller may apply high voltage to at least one of the refrigerating chamber thermoelectric module and the freezing compartment thermoelectric module when the freezing compartment is in a low-temperature cooling mode.

The controller may rotate at least one of the freezing chamber cooling fan and the freezing chamber heat dissipating fan at low RPM when the freezing compartment is in a high-temperature cooling mode. The controller may rotate at least one of the freezing chamber cooling fan and the freezing chamber heat dissipating fan at high RPM when freezing compartment is in a low-temperature cooling mode.

The controller may perform a simultaneous operation that drives the refrigerating chamber thermoelectric module, the refrigerating chamber cooling fan, the refrigerating chamber heat dissipating fan, the freezing compartment thermoelectric module, the freezing chamber cooling fan, and the freezing chamber heat dissipating fan, and opens the freezing compartment damper.

The controller may perform an exclusive freezing compartment operation that drives the freezing compartment thermoelectric module, the freezing chamber cooling fan, and the freezing chamber heat dissipating fan, and opens the freezing compartment damper.

The controller may perform an exclusive refrigerating chamber operation in which the refrigerating chamber thermoelectric module, the refrigerating chamber cooling fan, and the refrigerating chamber heat dissipating fan are driven, the freezing compartment thermoelectric module, the freezing chamber cooling fan, and the freezing chamber heat dissipating fan are stopped, and the freezing compartment damper is closed.

The controller may perform an exclusive refrigerating chamber defrosting operation that turns off the refrigerating chamber thermoelectric module and drives the refrigerating chamber cooling fan and the refrigerating chamber heat dissipating fan.

The controller may perform a simultaneous defrosting operation that drives the refrigerating chamber cooling fan and performs inverse voltage control on the freezing compartment thermoelectric module with the refrigerating chamber thermoelectric module off, when a refrigerating chamber temperature is higher by a set temperature than a refrigerating chamber target temperature during the exclusive refrigerating chamber defrosting operation.

The controller may perform a simultaneous defrosting operation that turns off the refrigerating chamber thermoelectric module, drives the refrigerating chamber cooling fan, and performs inverse voltage control on the freezing compartment thermoelectric module.

According to an embodiment of the present invention, since it is possible to cool the refrigerating chamber and the freezing chamber by using the refrigerating chamber thermoelectric module and the freezing compartment thermoelectric element, it is possible to minimize noise in comparison to using a compressor and it is also possible to efficiently cool the refrigerating chamber and the freezing chamber without a compressor.

Further, the cold air cooled by the refrigerating chamber thermoelectric module may absorb the heat of the freezing compartment by being guided to the second heat dissipating unit through the air guide and it is possible to maximally lower the temperature of the freezing chamber by using the refrigerating chamber thermoelectric module, the air guide, and the freezing chamber thermoelectric module.

BRIEF DESCRIPTION OF THE DRAWINGS

The above and other objects, features and other advantages of the present disclosure will be more clearly understood from the following detailed description when taken in conjunction with the accompanying drawings, in which.

DETAILED DESCRIPTION

Figure 1:
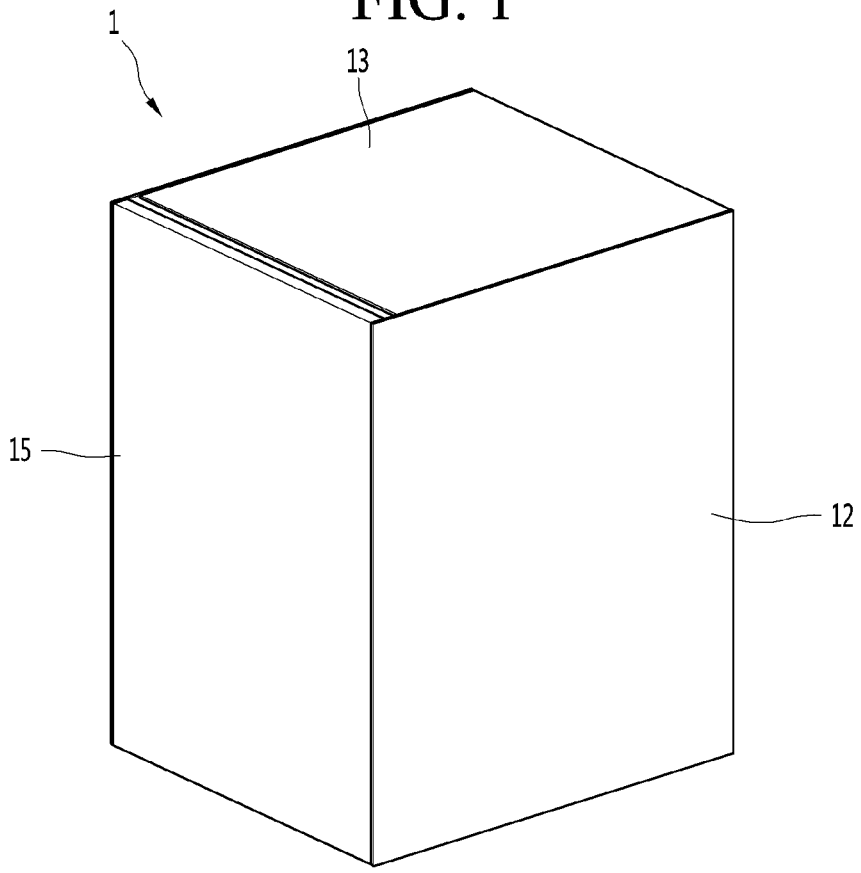
FIG. 1 is a perspective view of a refrigerator according to an embodiment of the present invention.

Hereinafter, exemplary embodiments of the present invention will be described in detail with reference to the accompanying drawings. The configuration or control method of devices to be described below are provided to describe embodiments of the present invention without limiting the scope of the present invention, and same reference numerals used throughout the specification may indicate the same components.

Figure 2:
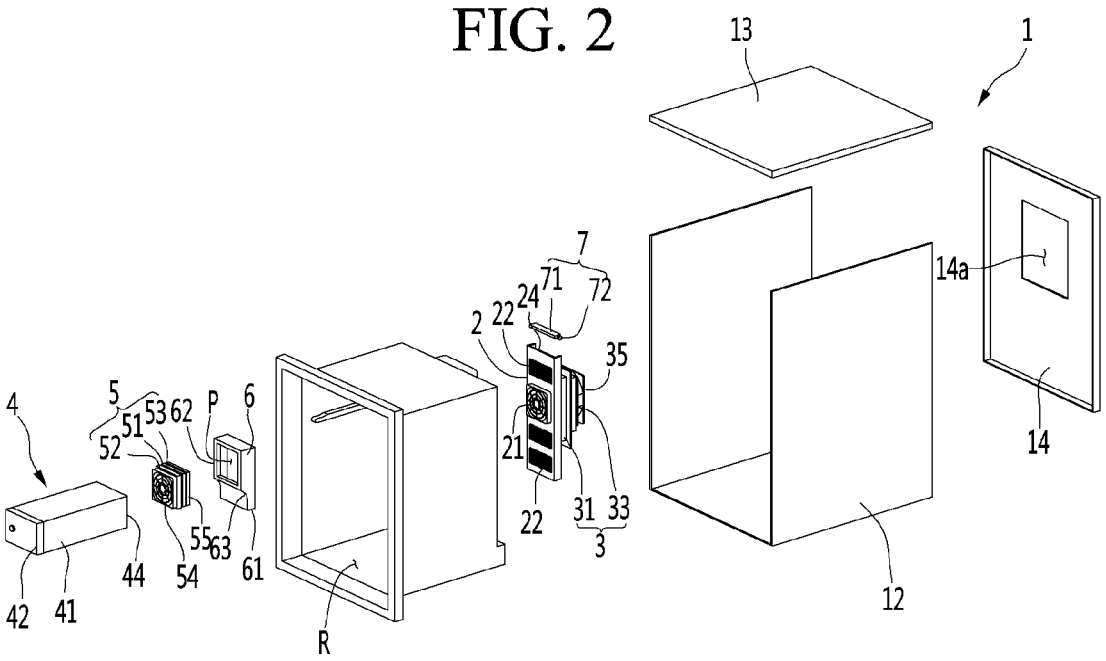
FIG. 2 is an exploded perspective view of the refrigerator according to an embodiment of the present invention.
Figure 3:
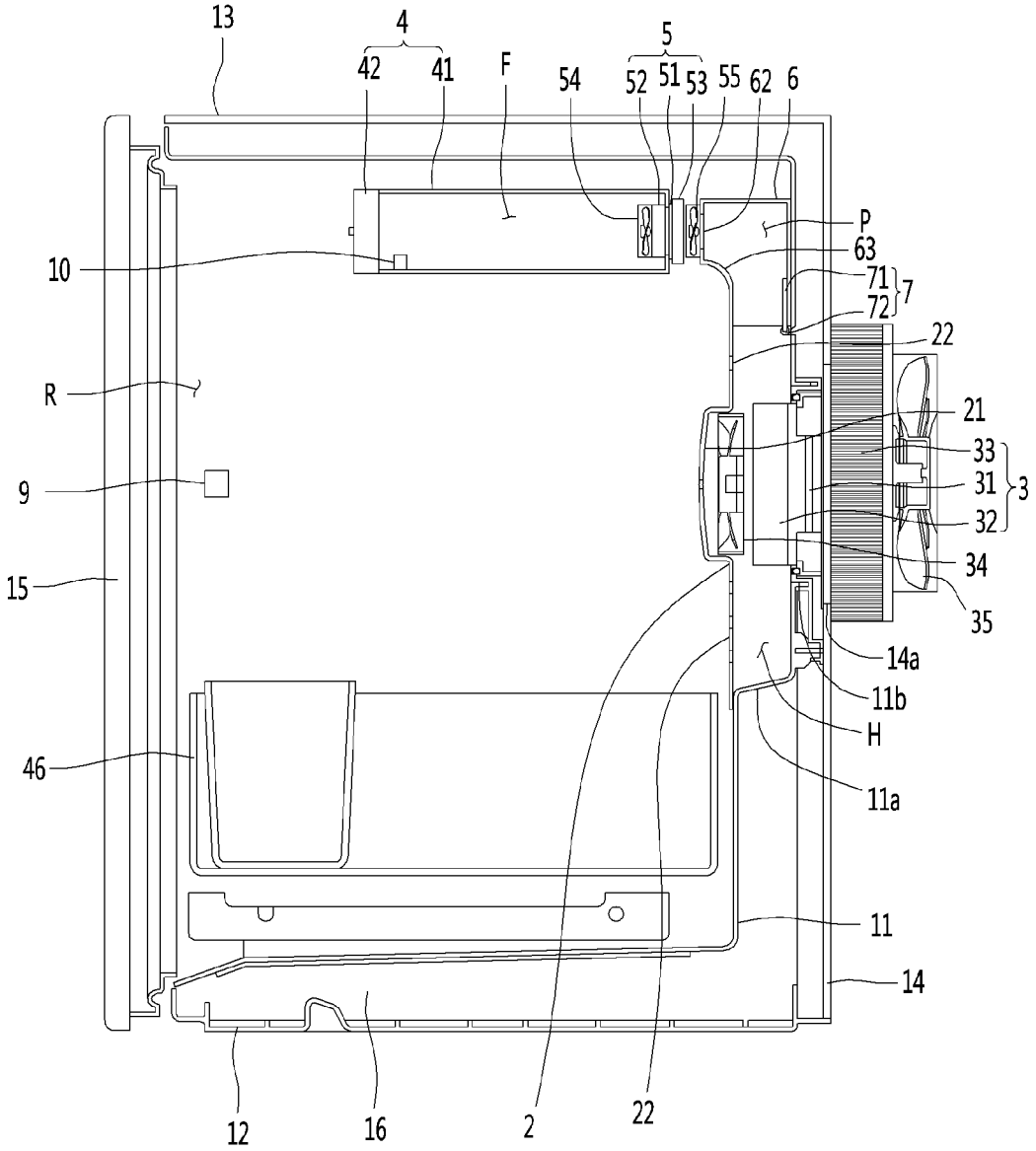
FIG. 3 is a cross-sectional view of the refrigerator according to an embodiment of the present invention.

FIG. 1 is a perspective view of a refrigerator according to an embodiment of the present invention, FIG. 2 is an exploded perspective view of the refrigerator according to an embodiment of the present invention, and FIG. 3 is a cross-sectional view of the refrigerator according to an embodiment of the present invention.

A refrigerator according to the embodiment may include a main body 1, a refrigerating chamber discharge duct 2, a refrigerating chamber thermoelectric module 3, a freezing compartment 4, and a freezing compartment thermoelectric module 5.

The main body 1 may include an inner case 11 having a storage chamber.

The storage chamber may be formed in the inner case 11. A front side of the inner case 11 may be open.

A thermoelectric module seat 11*a* may be formed at the inner case 11. The thermoelectric module seat 11*a* may be formed by protruding rearward a portion of the rear side of the inner case 11. A thermoelectric module seat hole 11*b* may be formed at the inner case 11. The refrigerating chamber thermoelectric module 3 may be disposed through the thermoelectric module seat hole 11*b*. The thermoelectric module seat hole 11*b* may be formed at the thermoelectric module seat 11*a*.

The main body 1 may further include a cabinet 12, 13, 14 that surrounds the inner case 11. The cabinet 12, 13, 14 may form the external appearance of the refrigerator. A heat insulator 16 may be disposed between the cabinet 12, 13, 14 and the inner case 11.

The cabinet 12, 13, 14 may be formed by combining a plurality of members. The cabinet 12, 13, 14 may include an outer cabinet 12, a top cover 13, and a back plate 14.

The outer cabinet 12 may be disposed outside the inner case 11. In detail, the outer cabinet 12 may be disposed at left and right sides of and under the inner case 11. However, the positional relationship of the outer cabinet 12 and the inner case 11 may be changed, as necessary.

The outer cabinet 12 may be disposed to cover the left side, the right side, and the bottom of the inner case 11 and may constitute the left side, the right side, and the bottom of the refrigerator.

The outer cabinet 12 may be composed of a plurality of members. The outer cabinet 12 may include a base forming the external appearance of the bottom of the refrigerator, a left cover disposed on the left side of the base, and a right cover disposed on the right side of the base. The members constituting the outer cabinet 12 may be made of different materials. For example, the base may be made of synthetic resin and the left plate and the right plate may be made of metal such as steel or aluminum.

The outer cabinet 12 may be formed by a single member, and in this case, the outer cabinet 12 may have a bottom plate, a left plate, and a right plate that are curved or bent. When the outer cabinet 12 is formed by one member, it may be made of steel such as steel or aluminum.

The top cover 13 may be disposed over the inner case 11. The top cover 13 may form the top of the refrigerator.

The back plate 14 may be vertically disposed. The back plate 14 may be disposed behind the inner case 11.

The back plate 14 may be disposed to face the rear side of the inner case 11 in the front-rear direction.

The back plate 14 may be disposed in contact with the inner case 11. The back plate 14 may be disposed close to the thermoelectric module seat 11*a* of the inner case 11.

A through-hole 14*a* through which the refrigerating chamber thermoelectric module 3 is disposed may be formed at the back plate 14. The through-hole 14*a* may be formed at a position corresponding to the thermoelectric module seat hole 11*b* of the inner case 11. The size of the through-hole 14*a* may be the same as or larger than the size of the thermoelectric module seat hole 11*b* of the inner case 11.

A door 15 may open/close the storage chamber. The front side of the inner case 11 may be open, and the door 15 may be rotatably connected to the main body 11, thereby being able to open/close the front side of the inner case 11.

The refrigerating chamber discharge duct 2 may be disposed in the inner case 11. The refrigerating chamber discharge duct 2 may divide the storage chamber into a heat exchange chamber H and a refrigerating chamber R.

The heat exchange chamber H may be a space defined between the refrigerating chamber discharge duct 2 and the inner case 11.

A refrigerating chamber suction port 21 for suctioning cold air in the refrigerating chamber R to the heat exchange chamber H may be formed at the refrigerating chamber discharge duct 2.

Refrigerating chamber discharge ports 22 for discharging cold air cooled through the heat exchange chamber H to the refrigerating chamber R may be formed at the refrigerating chamber discharge duct 2.

The refrigerating chamber thermoelectric module 3 may have a first thermoelectric element 31, a first heat absorbing unit 32, and a first heat dissipating unit 33 and may cool the refrigerating chamber R.

The first thermoelectric element 31 may be disposed between the first heat absorbing unit 32 and the first heat dissipating unit 33. The first thermoelectric element 31, which is a component that absorbs or generates heat using Peltier effect, uses a phenomenon in which a temperature difference is generated at both cross-sections of different metals coupled to each other when current is applied to the metals.

The first thermoelectric element 31 may have a cold side and a hot side and the temperature difference between the cold side and the hot side may depend on the voltage that is applied to the first thermoelectric element 31. The first thermoelectric element 31 may be operated such that the temperature difference between the hot side and the cold side is about 15□ to 25□, and when the temperature of the hot side is about 30□, the temperature of the cold side may be −5□ to +5□.

The first heat absorbing unit 32 may be disposed in the heat exchange chamber H and may cool the refrigerating chamber R. The first heat absorbing unit 32 is a cooling plate that absorbs surrounding heat and transmits the heat to the first thermoelectric element 31. The first heat absorbing unit 32 may be disposed in contact with the cold side of the first thermoelectric element 31. The first heat absorbing unit 32 may absorb heat of air flowing to the heat exchange chamber H from the refrigerating chamber R and transmit the heat to the cold side of the first thermoelectric element 31.

The first heat dissipating unit 33 may dissipate heat absorbed from the refrigerating chamber R to the outside of the refrigerator. The first heat dissipating unit 33 may be a heat sink that is increased in temperature by the first thermoelectric element 31. The first heat dissipating unit 33 may be disposed in contact with the hot side of the first thermoelectric element 31 and may dissipate heat from the hot side of the first thermoelectric element 31 to the outside of the refrigerator.

The refrigerator may further include a refrigerating chamber cooling fan 34 and a refrigerating chamber heat dissipating fan 35.

The refrigerating chamber cooling fan 34 may circulate cold air in the refrigerating chamber R to the heat exchange chamber H and the refrigerating chamber R.

The refrigerating chamber cooling fan 34 may be disposed to face the suction port 21. When the refrigerating chamber cooling fan 34 is driven, the air in the refrigerating chamber R may flow to the first heat absorbing unit 32 through the suction port 21 and may be cooled by exchanging heat with the first heat absorbing unit 32. The air cooled by the first heat absorbing unit 32 may be discharged to the refrigerating chamber R through the discharge ports 22, whereby the refrigerating chamber R may be maintained at low temperature.

The refrigerating chamber heat dissipating fan 35 may blow external air to the first heat dissipating unit 33. The refrigerating chamber heat dissipating fan 35 may be disposed to face the first heat dissipating unit 33 and may blow the air outside the refrigerator to the first heat dissipating unit 33.

The freezing compartment 4 may be disposed in the refrigerating chamber R and a freezing chamber F may be formed in the freezing compartment 4.

The freezing compartment 4 may include a freezing compartment inner case 41 having an open front side. The freezing compartment inner case 41 may have a hexahedral shape. The freezing chamber F may be a space defined in the freezing compartment inner case 41. The freezing compartment 4 may further include a freezing chamber door 42 for opening/closing the freezing chamber F.

A freezing compartment through-hole through which the compartment thermoelectric module 5 is disposed may be formed at the freezing compartment 4. The freezing compartment through-hole may be formed through a rear plate of the freezing compartment inner case 41.

At least one receiving member 46 may be disposed in the refrigerating chamber R. Food may be placed in or accommodated in the receiving member 46. The receiving member 46 may be a shelf or a drawer disposed in the refrigerating chamber inner case 11. The receiving member 46 may be disposed separately from the freezing compartment 4 in the freezing chamber F.

The freezing chamber F may be smaller in volume than the refrigerating chamber R. The freezing compartment thermoelectric module 5 may be smaller in size than the refrigerating chamber thermoelectric module 3.

The refrigerating chamber thermoelectric module 5 may have a second thermoelectric element 51, a second heat absorbing unit 52, and a second heat dissipating unit 53 and the second heat absorbing unit 52 may cool the freezing chamber F.

The second thermoelectric element 51 may be disposed between the second heat absorbing unit 52 and the second heat dissipating unit 53.

Similar to the first thermoelectric element 31, the second thermoelectric element 51 uses heat absorption or heat generation by Peltier effect and may have the same configuration as the first thermoelectric element 31.

The second thermoelectric element 51 may be smaller in size than the first thermoelectric element 31.

The second thermoelectric element 51, similar to the first thermoelectric element 31, may have a cold side and a hot side and the temperature difference between the cold side and the hot side may depend on the voltage that is applied to the second thermoelectric element 51.

The freezing compartment thermoelectric module 5 transmits heat absorbed from the freezing chamber F to the refrigerating chamber R and the second thermoelectric element 51 may be operated such that the temperature difference between the hot side and the cold side is about 9□ to 40□, in which when the temperature of the hot side is about 5□ to 15□, the temperature of the cold side may be −25□ to −6□.

The second heat absorbing unit 52 may be disposed in the freezing compartment 4 and may cool the freezing chamber F. The second heat absorbing unit 52 is a freezing compartment cooling plate that absorbs surrounding heat and transmits the heat to the second thermoelectric element 51. The second heat absorbing unit 52 may be disposed in contact with the cold side of the second thermoelectric element 51 and may absorb and transmit heat of the freezing chamber F to the second thermoelectric element 51.

The second heat dissipating unit 53 may discharge the heat absorbed from the freezing chamber F to the refrigerating chamber R outside the freezing compartment 4. The second heat dissipating unit 53 may be a freezing compartment heat sink that is increased in temperature by the second thermoelectric element 51. The second heat dissipating unit 53 may be disposed in contact with the hot side of the second thermoelectric element 51 and may dissipate heat from the hot side of the second thermoelectric element 51 to the outside of the freezing compartment 4.

The second heat dissipating unit 53 may be disposed between the freezing compartment 4 and the inner case 11. The second heat dissipating unit 53 may be spaced apart from the inner case 11. A gap may be formed between the second heat dissipating unit 53 and the inner case 11.

The refrigerator may further include a freezing chamber cooling fan 54 and a freezing chamber heat dissipating fan 55.

The freezing chamber cooling fan 54 may circulate cold air in the freezing compartment F to the second heat absorbing unit 52 and the freezing compartment F.

When the freezing chamber cooling fan 54 is driven, the air in the freezing chamber F may circulate through the second heat absorbing unit 52 and the freezing chamber F and the air cooled by the second heat absorbing unit 52 may keep the freezing chamber F at low temperature.

The freezing chamber heat dissipating fan 55 may blow cold air in the heat exchange chamber H to the second heat dissipating unit 53. The freezing chamber heat dissipating fan 55 may be disposed to face the second heat dissipating unit 53 and may blow cold air in a channel P to be described below to the second heat dissipating unit 53.

The freezing chamber heat dissipating fan 55 may blow cold air, which is discharged from the heat exchange chamber H to the refrigerating chamber R, to the second heat dissipating unit 53 and may blow cold air, which flows from the heat exchange chamber H to an air guide 6, and to the second heat dissipating unit 53.

The refrigerator may include the air guide 6 that forms the channel P for guiding cold air from the heat exchange chamber H to the second heat dissipating unit 53.

The channel P may be formed in the air guide 6 or may be formed between the inner case 11 and the air guide 6.

The air guide 6 may have an inlet at a lower portion through which air from the heat exchange chamber H flows inside and an outlet at an upper portion through which air passing through the channel P flows to the second heat dissipating unit 53. The inlet of the air guide 6 may be formed at an end of the air guide 6 and the outlet of the air guide 6 may be formed at the other end of the air guide 6.

When the refrigerator includes the air guide 6, the freezing chamber heat dissipating fan 55 may directly send the cold air in the heat exchange chamber H to the second heat dissipating unit 53.

The air guide 6 may be disposed between the refrigerating chamber discharge duct 2 and the second heat dissipating unit 53. The air guide 6 may be disposed between the refrigerating chamber discharge duct 2 and the freezing chamber heat dissipating fan 55. The freezing chamber heat dissipating fan 55 may be disposed between the second heat dissipating unit 53 and the air guide 6 and may blow the cold air guided to the air guide 6 to the second heat dissipating unit 53.

When at least one of the refrigerating chamber cooling fan 34 and the freezing chamber heat dissipating fan 55 is driven, the cold air in the heat exchange chamber H may be guided to the second heat dissipating unit 53 through the air guide 6. The air guide 6 may be disposed over the refrigerating chamber discharge duct 2. The air guide 6 may extend behind the second heat dissipating unit 53 over the refrigerating chamber discharge duct 2.

When the refrigerator includes the air guide 6, some of the cold air cooled by the first heat absorbing unit 32 in the heat exchange chamber H may flow to the second heat dissipating unit 53 without causing increase in temperature to the food, etc., in the refrigerating chamber R.

The cold air guided to the second heat dissipating unit 53 by the air guide 6 has not exchanged heat with food, etc., in the refrigerating chamber R and is lower in temperature than the cold air that has exchanged heat with the food, etc., after being discharged to the refrigerating chamber R through the refrigerating chamber discharge ports 22.

The second heat dissipating unit 53 and the second heat absorbing unit 52 have a predetermined temperature difference (about 9□ to 40□). When some of the cold air cooled by the first heat absorbing unit 32 in the heat exchange chamber H flows to the second heat dissipating unit 53 without exchanging heat with food, etc., the temperatures of the second heat dissipating unit 53 and the second heat absorbing unit 52 may be lowered, as compared with the case in which cold air that has exchanged heat with food, etc., is supplied to the second heat dissipating unit 53.

That is, when the refrigerator includes the air guide 6, the temperature of the freezing chamber F may be further lowered, when compared with the case where the refrigerator does not include the air guide 6.

A first end 61 of the air guide 6 may be in contact with the refrigerating chamber discharge duct 2 and a second end 62 may face the second heat dissipating unit 53. The first end 61 of the air guide 6 may be connected to an upper end 24 (see FIG. 2) of the refrigerating chamber discharge duct 2 and the second end 62 of the air guide 6 may be positioned behind the second heat dissipating unit 53.

The second end 62, which faces the second heat dissipating unit 53, of the air guide 6 may be spaced apart from a rear end 44 (see FIG. 2) of the freezing compartment 4 and cold air flowing to the second heat dissipating unit from the air guide 6 may flow to the refrigerating chamber R after exchanging heat with the second heat dissipating unit 53.

The air guide 6 may further have an expanding portion 63 that gradually expands upward. The freezing compartment 4 may be disposed higher than the refrigerating chamber discharge duct 2. The channel P may increase in cross-section as it goes upward from the lower portion of the expanding portion 63. The expanding portion 63 may be disposed between the upper end 24 of the refrigerating chamber discharge duct 2 and the second heat dissipating unit 53.

The refrigerating chamber discharge duct 2 may be disposed closer to the inner case 11 than the freezing compartment 4 and the rear end 44 of the freezing compartment 4 may be spaced apart from the rear plate of the inner case 11 in the front-rear direction. The expanding portion 63 may be inclined at a predetermined angle or may be rounded between the upper end 24 of the refrigerating chamber discharge duct 2 and the rear end 44 of the freezing compartment 4.

The refrigerator may further include a freezing compartment damper 7 that controls the cold air that flows to the second heat dissipating unit 53 through the channel P.

The freezing compartment damper 7 passes or blocks the cold air, which flows toward the second heat dissipating unit 53, of the cold air cooled in the heat exchange chamber H and may have a closing mode and an opening mode that are selectively performed.

The freezing compartment damper 7 may be disposed in at least any one of the refrigerating chamber discharge duct 2 and the air guide 6.

The freezing compartment damper 7 may include a flow path body having a passage for air, a damper body 71 that opens/closes the passage of the flow path body, and a driving unit 72, such as a motor, that is connected to the damper body 71 directly or through at least one power transmission member to open/close the damper body 71.

The flow path body may be disposed in one of the refrigerating chamber discharge duct 2 and the air guide 6, the damper body 71 may be rotatably connected to the flow path body, and the driving unit 72, such as a motor, is mounted on the flow path body and rotate the damper body 71.

The freezing compartment damper 7 may be disposed with the damper body 71 rotatably disposed in one of the refrigerating chamber discharge duct 2 and the air guide 6 without a specific flow path body, and in this case, the driving unit 72, such as a motor, may be mounted in the refrigerating chamber discharge duct 2 or the air guide 6 and rotate the damper body 71.

In the opening mode of the freezing compartment damper 7, the damper body 71 may be rotated to open the channel P and the cold air in the heat exchange chamber H may flow toward the second heat dissipating unit 53 through the channel P.

In the closing mode of the freezing compartment damper 7, the damper body 71 may be rotated to close the channel P and the cold air in the heat exchange chamber H is blocked by the damper body 71, so it cannot flow directly to the second heat dissipating unit 53. Accordingly, the cold air that cannot flow to the second heat dissipating unit 53 by being blocked by the freezing compartment damper 7 may be discharged to the refrigerating chamber R through the refrigerating chamber discharge ports 22.

The area of the channel P that is opened by the freezing compartment damper 7 may be controlled in several steps and, in this case, the flow rate of the cold air flowing to the second heat dissipating unit 53 from the heat exchange chamber H may be more finely controlled in several steps.

Figure 4:
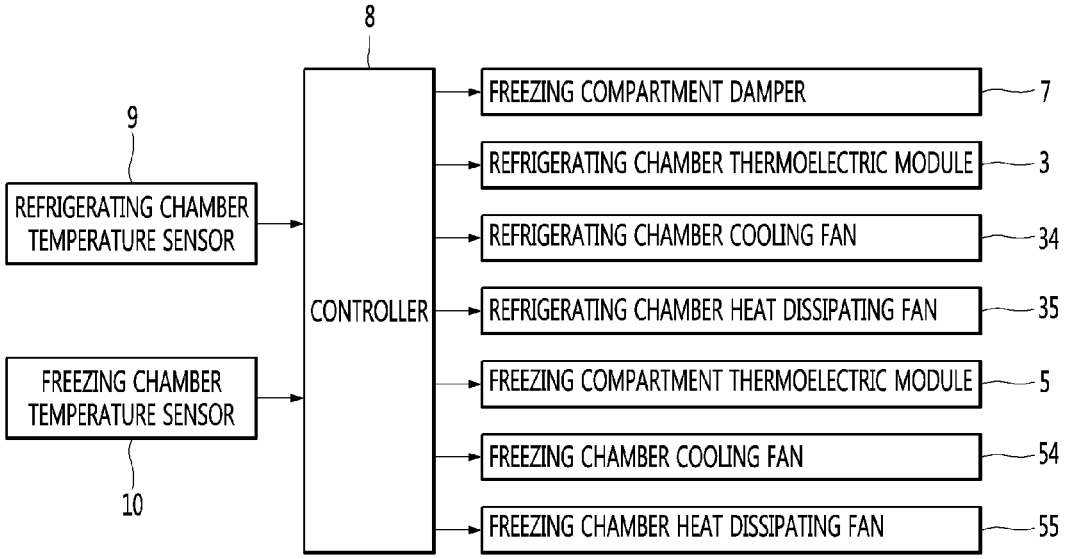
FIG. 4 is a control block diagram of the refrigerator according to an embodiment of the present invention.
Figure 5:
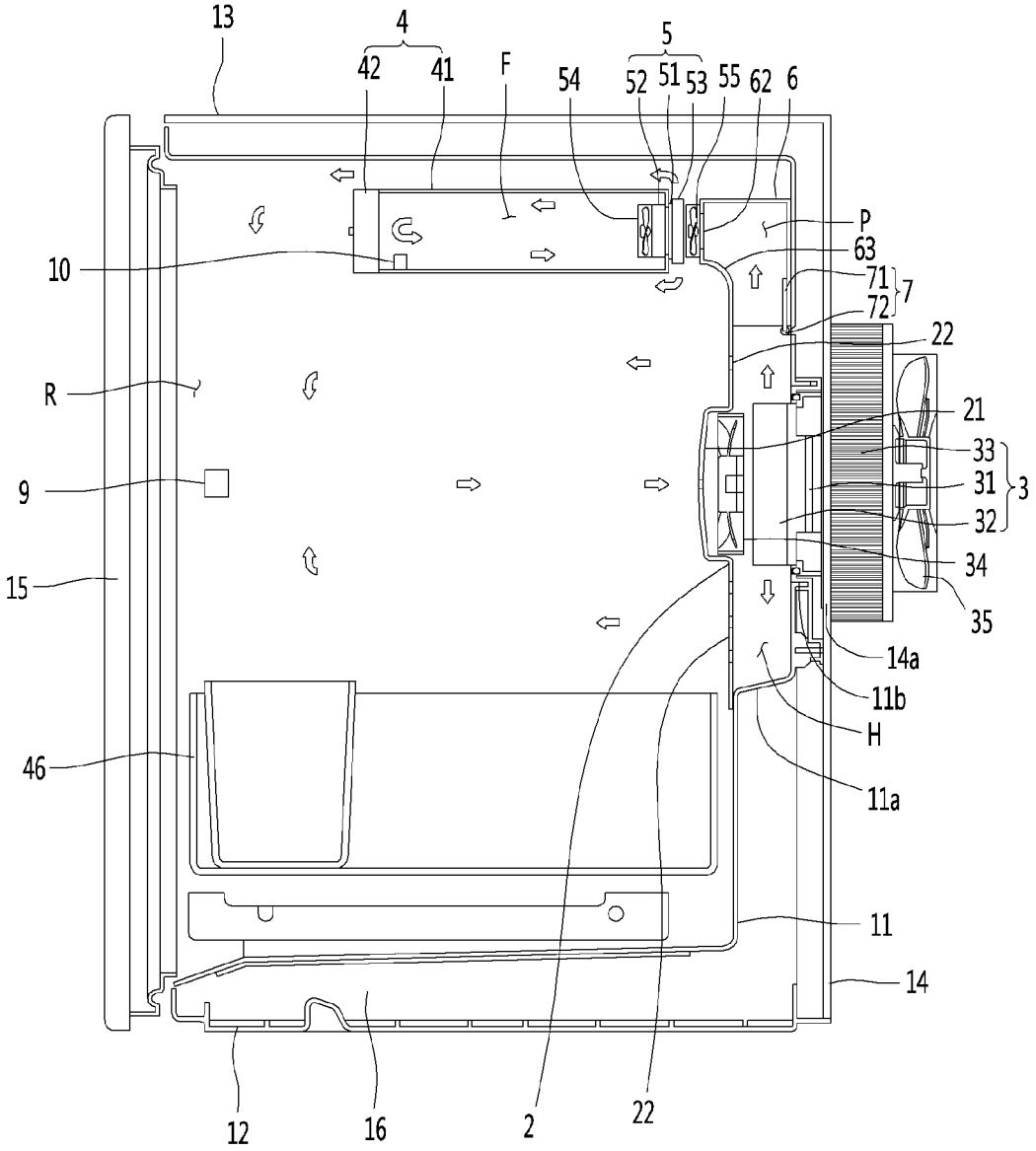
FIG. 5 is a cross-sectional view showing airflow when the refrigerator according to an embodiment of the present invention is in simultaneous operation.
Figure 6:
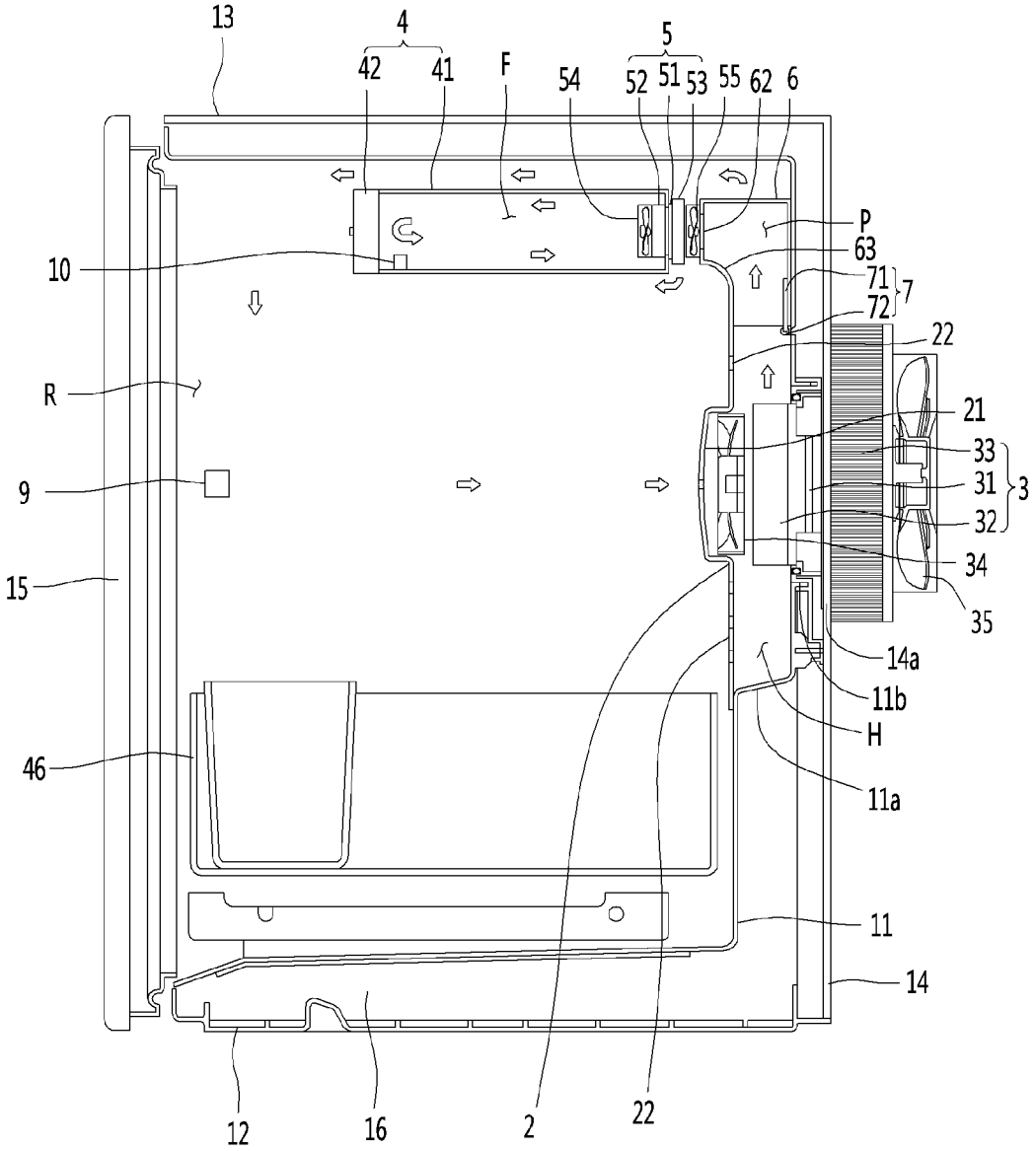
FIG. 6 is a cross-sectional view showing airflow when the refrigerator according to an embodiment of the present invention is in exclusive freezing chamber operation.
Figure 7:
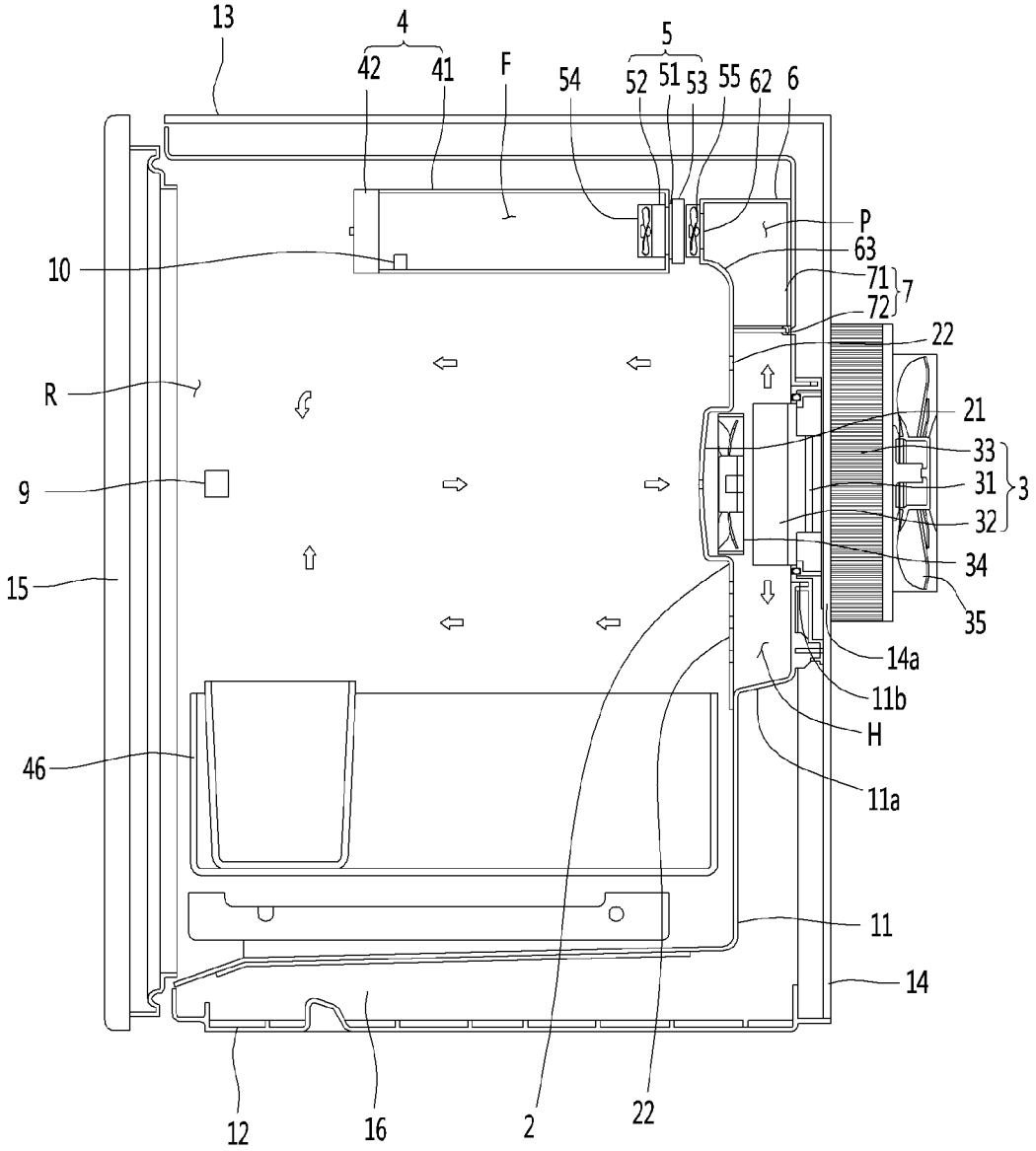
FIG. 7 is a cross-sectional view showing airflow when the refrigerator according to an embodiment of the present invention is in an exclusive refrigerating chamber operation.
Figure 8:
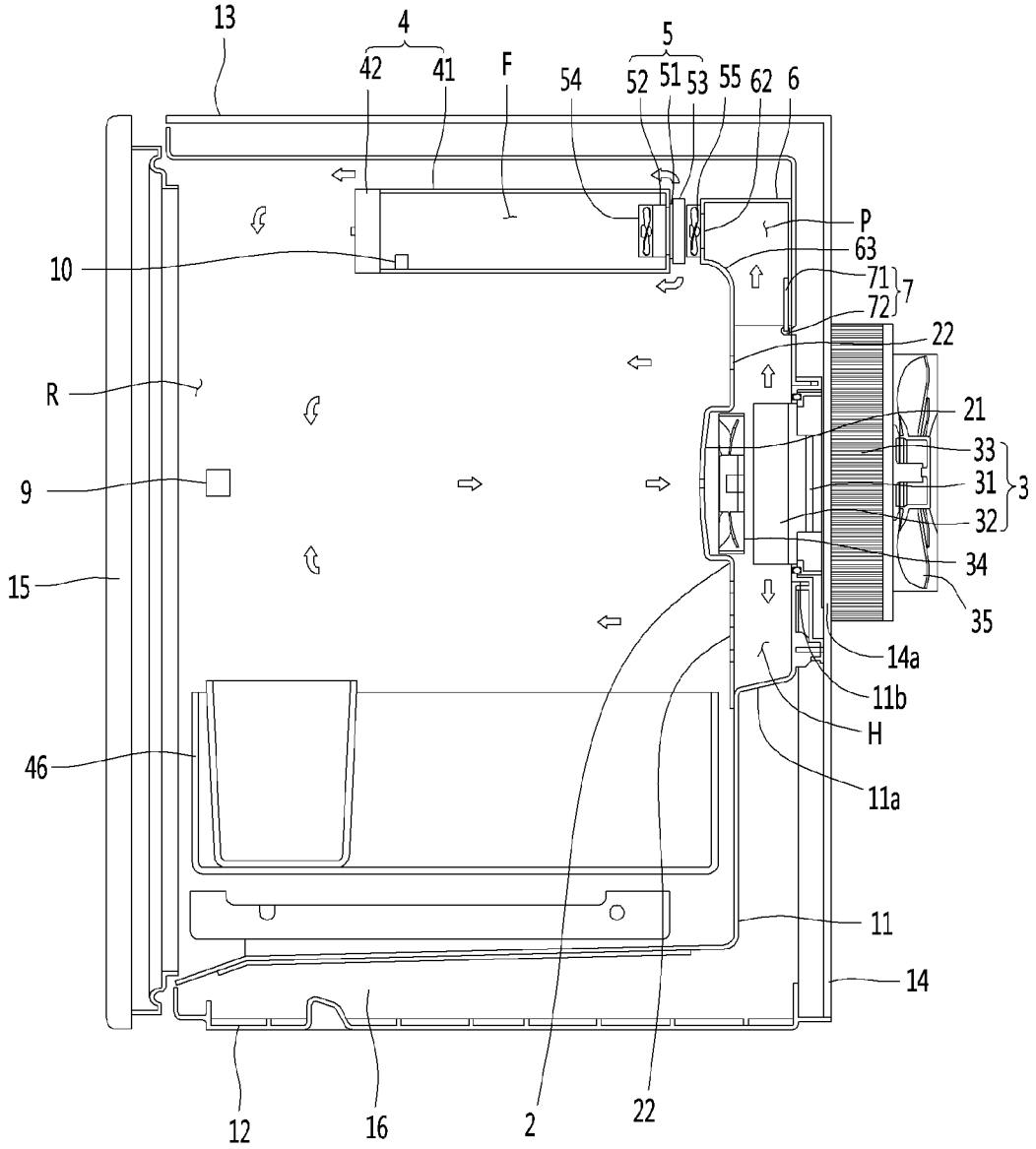
FIG. 8 is a cross-sectional view showing airflow when the refrigerator according to an embodiment of the present invention is in an exclusive defrosting operation.
Figure 9:
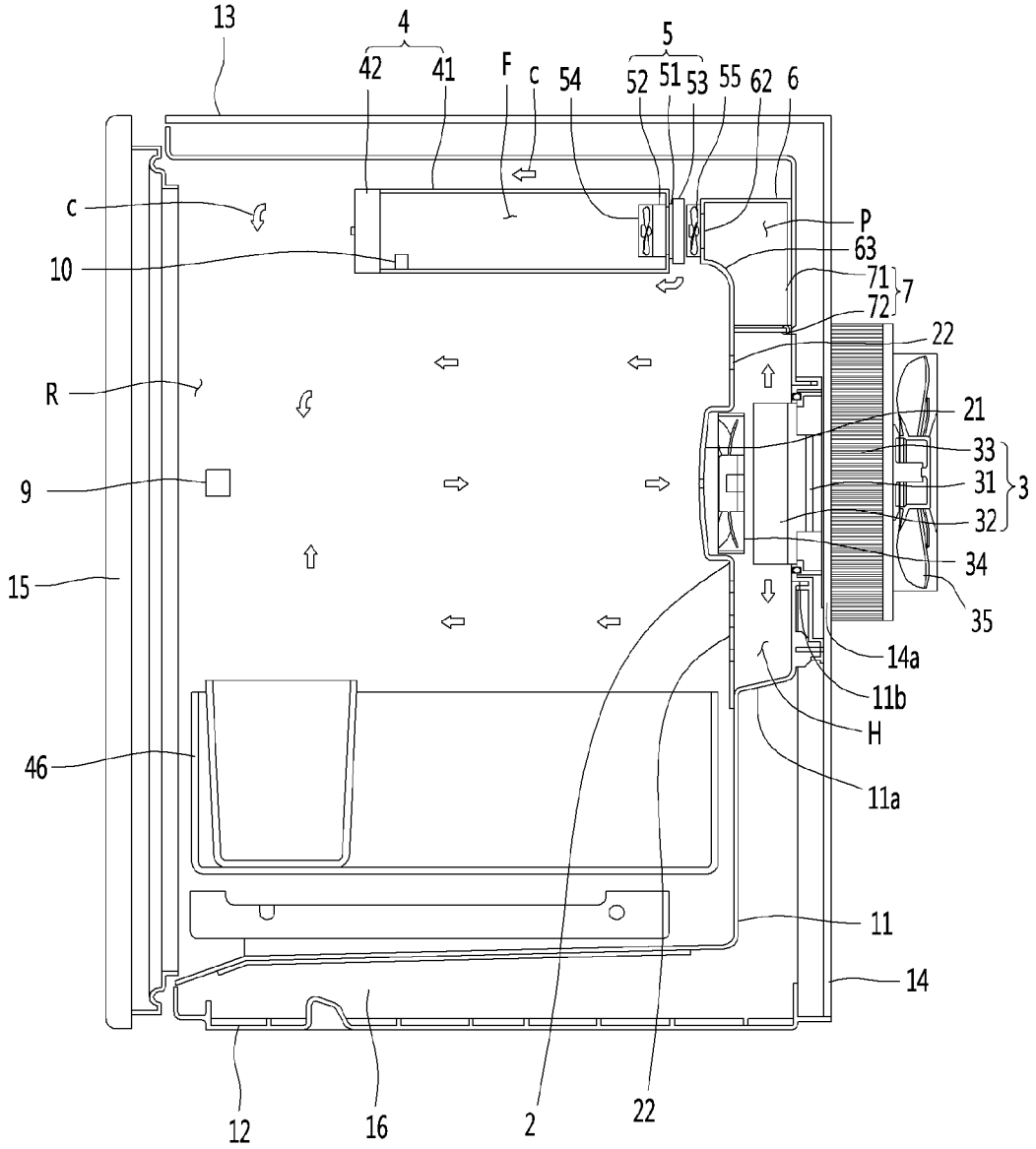
FIG. 9 is a cross-sectional view showing airflow when the refrigerator according to an embodiment of the present invention is in simultaneous defrosting operation.

FIG. 4 is a control block diagram of the refrigerator according to an embodiment of the present invention. FIG. 5 is a cross-sectional view showing airflow when the refrigerator according to an embodiment of the present invention is in simultaneous operation, FIG. 6 is a cross-sectional view showing airflow when the refrigerator according to an embodiment of the present invention is in an exclusive freezing chamber operation, FIG. 7 is a cross-sectional view showing airflow when the refrigerator according to an embodiment of the present invention is in an exclusive refrigerating chamber operation, FIG. 8 is a cross-sectional view showing airflow when the refrigerator according to an embodiment of the present invention is in an exclusive defrosting operation, and FIG. 9 is a cross-sectional view showing airflow when the refrigerator according to an embodiment of the present invention is in simultaneous defrosting operation.

The refrigerator may further include a controller 8. The controller 8 includes a microprocessor based electronic circuit, a logical electronic circuit and/or integrated circuit (IC). The controller 8 may control the refrigerating chamber thermoelectric module 3, the refrigerating chamber cooling fan 34, the refrigerating chamber heat dissipating fan 35, the freezing compartment thermoelectric module 5, the freezing chamber cooling fan 54, and the freezing chamber heat dissipating fan 55. The controller 8 may also control the freezing compartment damper 7.

The refrigerator may further include a refrigerating chamber temperature sensor 9 that senses the temperature of the refrigerating chamber R and a freezing chamber temperature sensor 10 that senses the temperature of the freezing chamber F.

The refrigerator may control the refrigerating chamber thermoelectric module 3, the refrigerating chamber cooling fan 34, the refrigerating chamber heat dissipating fan 35, the freezing compartment thermoelectric module 5, the freezing chamber cooling fan 54, the freezing chamber heat dissipating fan 55, and the freezing compartment damper 7 on the basis of the refrigerating chamber temperature sensed by the refrigerating chamber temperature sensor 9 and the freezing chamber temperature sensed by the freezing chamber temperature sensor 10.

The controller 8 may control a temperature of the cold air that is blown to the second heat dissipating unit 53 by changing a voltage of the refrigerating chamber thermoelectric module 3.

When the controller 8 applies high voltage to the first thermoelectric element 31, the temperature of the cold air flowing to the second heat dissipating unit 53 is low because the temperature of the first heat absorbing unit 32 is low, so the temperature of the second heat absorbing unit 52 is low.

On the contrary, when the controller 8 applies low voltage to the first thermoelectric element 31, the temperature of the first heat absorbing unit 32 is higher than the case where high voltage is applied and the temperature of the cold air flowing to the second heat dissipating unit 53 is also higher, so the temperature of the second heat dissipating unit 53 and the temperature of the second heat absorbing unit 52 are higher than the case where high voltage is applied.

The controller 8 may change the temperature of the freezing chamber F by changing a rotational speed of at least one of the refrigerating chamber cooling fan 34, the freezing chamber cooling fan 54, and the freezing chamber heat dissipating fan 55.

The refrigerator may be controlled in various operation modes, depending on the modes of the freezing chamber F. The refrigerator may be configured such that a user may select a high-temperature cooling mode and a low-temperature cooling mode for the freezing compartment 4 and the controller 8 may differently control the refrigerating chamber thermoelectric module 3, the freezing compartment thermoelectric module 5, the freezing chamber cooling fan 54, and the freezing chamber heat dissipating fan 55 in accordance with the high-temperature cooling mode and the low-temperature cooling mode of the freezing compartment 4.

When the freezing compartment 4 is in the high-temperature cooling mode, the controller 8 may apply low voltage to at least one of the refrigerating chamber thermoelectric module 3 and the freezing compartment thermoelectric module 5. When the freezing compartment 4 is in the high-temperature cooling mode, the controller 8 may rotate at least one of the freezing chamber cooling fan 54 and the freezing chamber heat dissipating fan 55 at a low rotational speed.

When the freezing compartment 4 is in the low-temperature cooling mode, the controller 8 may apply high voltage to at least one of the refrigerating chamber thermoelectric module 3 and the freezing compartment thermoelectric module 5. When the freezing compartment 4 is in the low-temperature cooling mode, the controller 8 may rotate at least one of the freezing chamber cooling fan 54 and the freezing chamber heat dissipating fan 55 at a high rotational speed. The target temperature range of the freezing chamber F may be lower in the low-temperature cooling mode than in the high-temperature cooling mode.

For example, the high-temperature cooling mode may be a mode for cooling items such as fish or vegetables having a target temperature range higher than that for meat and the low-temperature cooling mode may be a mode for cooling items such as meat having a target temperature range relatively lower than that of fish or vegetables.

The controller 8 may differently control the first thermoelectric element 31, the second thermoelectric element 51, the freezing chamber cooling fan 54, and the freezing chamber heat dissipating fan 55 in accordance with the high-temperature cooling mode and the low-temperature cooling mode.

For example, when the freezing chamber F is set in the high-temperature cooling mode having a relatively high target temperature range such as fish/vegetables, the controller 8 may drive the refrigerating chamber cooling fan 34 and the refrigerating chamber heat dissipating fan 35, may operate the first thermoelectric element 31 and the second thermoelectric element 51 at low voltage, and may drive the freezing chamber cooling fan 54 and the freezing chamber heat dissipating fan 55 at low rotational speeds.

In contrast, when the freezing chamber F is set in the low-temperature cooling mode having a relatively low target temperature range such as meat, the controller 8 may drive the refrigerating chamber cooling fan 34 and the refrigerating chamber heat dissipating fan 35, may operate the first thermoelectric element 31 and the second thermoelectric element 51 at high voltage, and may drive the freezing chamber cooling fan 54 and the freezing chamber heat dissipating fan 55 at high rotational speeds.

The refrigerator, as shown in FIGS. 5 to 9, may be selectively operated in several operation modes. The operation modes may include simultaneous operation (see FIG. 5) in which the freezing chamber F and the refrigerating chamber R are both cooled, an exclusive freezing chamber operation (see FIG. 6) in which only the freezing chamber F is cooled and cooling the refrigerating chamber R is temporarily stopped, an exclusive refrigerating chamber operation (see FIG. 7) in which only the refrigerating chamber R is cooled and cooling the freezing chamber F is temporarily stopped, and defrosting operation (see FIGS. 8 and 9) in which at least one of the freezing chamber F and the refrigerating chamber R is defrosted.

In the simultaneous operation, the controller 8 can drive the refrigerating chamber thermoelectric module 3, the refrigerating chamber cooling fan 34, the refrigerating chamber heat dissipating fan 35, the freezing compartment thermoelectric module 5, the freezing chamber cooling fan 54, and the freezing chamber heat dissipating fan 55 and can open the freezing compartment damper 7.

The controller 8 may perform the simultaneous operation regardless of the freezing chamber temperature when the refrigerating chamber temperature is in a dissatisfactory range, and may perform the simultaneous operation when the refrigerating chamber temperature is in a dissatisfactory range and the freezing chamber temperature is in a dissatisfactory range.

In the simultaneous operation, the cold air in the refrigerating chamber R, as shown in FIG. 5, may be sucked into the heat exchange chamber H through the refrigerating chamber suction port 21 of the refrigerating chamber discharge duct 2 and then may flow to the first heat absorbing unit 32. The cold air flowing to the first heat absorbing unit 32 may be cooled by the first heat absorbing unit 32. Some of the cold air cooled by the first heat absorbing unit 32 is discharged to the refrigerating chamber R through refrigerating chamber discharge ports 22, whereby it may cool the refrigerating chamber R. The other portion of the cold air cooled by the first heat absorbing unit 32 may flow into channel P of the air guide 6.

The cold air flowing in the channel P of the air guide 6 may be sent to the second heat dissipating unit 53 by the air guide 6, and then may flow to the refrigerating chamber R after further cooling by the second heat dissipating unit 53. The cold air flowing to the refrigerating chamber R after further cooling by the second heat dissipation unit 53 may be mixed with the cold air in the refrigerating chamber R.

In the simultaneous operation, the refrigerating chamber R and the freezing chamber F may be simultaneously cooled.

In the exclusive freezing chamber operation, the controller 8 may drive the freezing compartment thermoelectric module 5, freezing chamber cooling fan 54, and the freezing chamber heat dissipating fan 55 and may open the freezing compartment damper 7. In the exclusive freezing chamber operation, the controller 8 may drive the refrigerating chamber heat dissipating fan 35. In the exclusive freezing chamber operation, the controller 8 may drive the refrigerating chamber cooling fan 34. In the exclusive freezing chamber operation, the controller 8 may keep the refrigerating chamber thermoelectric module 3 off.

When the refrigerating chamber temperature is in a satisfactory range, the controller 8 may perform the exclusive freezing chamber operation.

The satisfactory range of the refrigerating chamber temperature, which is a range of the refrigerating chamber target temperature, may be the range from a lower limit target temperature that is set lower by a set temperature (e.g., 1□) lower than the refrigerating chamber target temperature) to an upper limit target temperature that is set higher by a set temperature (e.g., 1□) higher than the refrigerating chamber target temperature).

In the exclusive freezing chamber operation, the cold air in the refrigerating chamber R, as shown in FIG. 6, may be sucked into the heat exchange chamber H through the refrigerating chamber suction port 21 of the refrigerating chamber discharge duct 2 and then may flow to the first heat absorbing unit 32. The air flowing to the first heat absorbing unit 32 may pass through the first heat absorbing unit 32 and then flow into the channel P of the air guide 6. The cold air flowing in the channel P of the air guide 6 may be sent to the second heat dissipating unit 53 by the air guide 6, and then may flow to the refrigerating chamber R after removing heat from the second heat dissipating unit 53. The cold air flowing to the refrigerating chamber R after removing heat from the second heat dissipation unit 53 may be mixed with the cold air in the refrigerating chamber R.

In the exclusive freezing chamber operation, the cold air in the refrigerating chamber R may circulate through the channel guide 6, the second heat dissipating unit 53, and the refrigerating chamber R. Further, the cold air in the refrigerating chamber R may be used to remove heat from the second heat dissipating unit 53 and the freezing chamber F may be cooled.

The controller 8 having the simultaneous operation as a fundamental operation, may enter the exclusive freezing chamber operation when the refrigerating chamber temperature satisfies the refrigerating chamber temperature range, and may return to the simultaneous operation when the refrigerating chamber temperature becomes in the dissatisfactory range. That is, the controller 8 may alternately perform the simultaneous operation and the exclusive freezing chamber operation in accordance with the freezing chamber temperature and the refrigerating chamber temperature.

In the exclusive freezing chamber operation described above, the temperature of the refrigerating chamber R may be gradually increased by heat dissipated by the second heat dissipating unit 55, and the temperature of the refrigerating chamber R may become in the dissatisfactory range. The controller 8 may stop the exclusive freezing chamber operation and enter into the simultaneous operation to cool the refrigerating chamber R.

The controller 8 may also perform the exclusive refrigerating chamber operation other than alternately performing the simultaneous operation and the exclusive freezing chamber operation.

In the exclusive refrigerating chamber operation, the controller 8 may drive the refrigerating chamber thermoelectric module 3, the refrigerating chamber cooling fan 34, and the refrigerating chamber heat dissipating fan 35. In the exclusive refrigerating chamber operation, the controller 8 may stop the freezing compartment thermoelectric module 5, the freezing chamber cooling fan 54, and the freezing chamber heat dissipating fan 55. In the exclusive refrigerating chamber operation, the controller 8 may open or close the freezing compartment damper 7, but it may be preferable to close the freezing compartment damper 7 so that the cold air cooled by the first heat absorbing unit 32 may be quickly supplied to the refrigerating chamber R.

When the refrigerating chamber temperature is in a dissatisfactory range and the freezing chamber temperature is in a satisfactory range, the controller 8 may start the exclusive refrigerating chamber operation.

The satisfactory range of the freezing chamber temperature, which is a range of the freezing chamber target temperature, may be the range from a lower limit target temperature that is set lower by a set temperature (e.g., 1□) lower than the freezing chamber target temperature) to an upper limit target temperature that is set higher by a set temperature (e.g., 1□) higher than the freezing chamber target temperature).

In the exclusive refrigerating chamber operation, the cold air in the refrigerating chamber R, as shown in FIG. 7, may be sucked into the heat exchange chamber H through the refrigerating chamber suction port 21 of the refrigerating chamber discharge duct 2 and then may flow to the first heat absorbing unit 32. The air flowing to the first heat absorbing unit 32 may be cooled by the first heat absorbing unit 32, and the whole cold air cooled by the first heat absorbing unit 32 is blocked by the freezing compartment damper 7, so it may be discharged to the refrigerating chamber R through the refrigerating chamber discharge ports 22 without flowing to the channel P of the air guide 6. Further, the cold air in the refrigerating chamber R may cool the refrigerating chamber R by circulating through the first heat absorbing unit 32 and the refrigerating chamber R. In the exclusive refrigerating chamber operation, the refrigerating chamber R may be quickly cooled without the second heat dissipating unit 53 being increased in temperature.

When the refrigerator is in the exclusive refrigerating chamber operation, the freezing chamber temperature may become in a dissatisfactory range, and in this case, the controller 8 may stop the exclusive refrigerating chamber operation and enter into the simultaneous operation to cool the freezing chamber F.

In the defrosting operation, the controller 8 may defrost at least one of the first heat absorbing unit 32 and the second heat absorbing unit 52. When an accumulated operation time of the first thermoelectric element 31 reaches a predetermined time, the controller 8 may start the defrosting operation to defrost the first heat absorbing unit 32.

The controller 8 may naturally defrost the first heat absorbing unit 32 using the cold air in the refrigerating chamber R. Further, the controller 8 may defrost the second heat absorbing unit 52 by applying an inverse voltage to the second thermoelectric element 51.

The defrosting operation may be an exclusive refrigerating chamber defrosting operation (see FIG. 8) in which only the refrigerating chamber R is defrosted and may be a simultaneous defrosting operation (see FIG. 9) in which both of the refrigerating chamber R and the freezing chamber F are defrosted.

The controller 8 may sequentially perform the exclusive refrigerating chamber defrosting operation and the simultaneous defrosting operation or may perform only the simultaneous defrosting operation.

When the controller 8 sequentially performs the exclusive refrigerating chamber defrosting operation and the simultaneous defrosting operation and the refrigerator satisfies a defrosting condition, the controller 8 may perform the exclusive refrigerating chamber defrosting operation that turns off the refrigerating chamber thermoelectric module 3 and drives the refrigerating chamber cooling fan 34 and the refrigerating chamber heat dissipating fan 35.

In the exclusive refrigerating chamber defrosting operation, the cold air in the refrigerating chamber R may defrost the first heat absorbing unit 32 by flowing to the first heat absorbing unit 32, as shown in FIG. 8, and the cold air that has defrosted the first heat absorbing unit 32 may be discharged to the refrigerating chamber R through the refrigerating chamber discharge ports 22.

In the exclusive refrigerating chamber defrosting operation, the controller 8 may open the freezing compartment damper 7.

In the exclusive refrigerating chamber defrosting operation, when the freezing compartment damper 7 is opened, some of the cold air that has defrosted the first heat absorbing unit 32 may flow to the second heat dissipating unit 53 through the channel P of the air guide 6 and then may be discharged to the refrigerating chamber R after being increased in temperature by the second heat dissipating unit 53. When the exclusive refrigerating chamber defrosting operation is performed with the freezing compartment damper 7 opened, the cold air increased in temperature by the second heat dissipating unit 53 may be discharged to the refrigerating chamber R. The air circulating through the refrigerating chamber R, the first heat absorbing unit 32, the air guide 6, and the second heat dissipating unit 53 may quickly defrost the first heat absorbing unit 32, so the entire time for the exclusive refrigerating chamber defrosting operation may be reduced.

When the refrigerating chamber temperature becomes higher by a set temperature than the refrigerating chamber target temperature during the exclusive refrigerating chamber defrosting operation, the controller 8 may start the simultaneous defrosting operation. In the simultaneous defrosting operation, the controller 8 may drive the refrigerating chamber cooling fan 34 and perform an inverse voltage control on the freezing compartment thermoelectric module 5 while keeping the refrigerating chamber thermoelectric module 3 off. When the freezing compartment damper 7 is closed in the exclusive refrigerating chamber defrosting operation, the controller 8 may open the freezing compartment damper 7, and when the freezing compartment damper 7 is open in the exclusive refrigerating chamber defrosting operation, the controller 8 may keep the freezing compartment damper 7 open. The simultaneous defrosting operation may be an operation that is performed with the freezing compartment damper 7 open.

The set temperature may be a temperature that is set such that a rapid increase of the temperature of the refrigerating chamber R may be sensed, such as 2E.

In inverse voltage control of the freezing compartment thermoelectric module 5, the second thermoelectric element 51 may heat the second heat absorbing unit 52 and cool the second heat dissipating unit 53. In the simultaneous defrosting operation, the cold air in the refrigerating chamber R may defrost the first heat absorbing unit 32 by flowing to the first heat absorbing unit 32, like shown in FIG. 8, and the cold air that has defrosted the first heat absorbing unit 32 may be discharged to the refrigerating chamber R through the refrigerating chamber discharge ports 22. The other portion of the cold air that has defrosted the first heat absorbing unit 32 may flow to the second heat dissipating unit 53 through the channel P of the air guide 6 and then may be discharged to the refrigerating chamber R after being cooled by the second heat dissipating unit 53. The air cooled by the second heat dissipating unit 53 may be discharged to the refrigerating chamber R and lower the temperature of the refrigerating chamber R. In this case, the temperature of the refrigerating chamber R may drop and the temperature of the refrigerating chamber R may drop under a set temperature without being maintained over the set temperature for a long time.

In the simultaneous defrosting operation, the first heat absorbing unit 32 may be gradually naturally defrosted by the cold air in the refrigerating chamber R, the second heat absorbing unit 52 may be defrosted by the second thermoelectric element 51, and the temperature of the refrigerating chamber R is not rapidly increased.

When the refrigerating satisfies the defrosting condition, the controller 8 may perform only the simultaneous defrosting operation without performing the refrigerating chamber defrosting operation, and in this case, the controller 8 may turn off the refrigerating chamber thermoelectric module 3, drives the refrigerating chamber cooling fan 34, and perform inverse voltage control on the freezing compartment thermoelectric module 5. As shown in FIG. 9, the controller 8 may close the freezing compartment damper 7, and when the freezing compartment damper 7 is already closed, the controller 8 may keep the freezing compartment damper 7 closed.

The above description merely explains the spirit of the present invention and the present invention may be changed and modified in various ways without departing from the spirit of the present invention by those skilled in the art.

Accordingly, the embodiments described herein are provided merely not to limit, but to explain the spirit of the present invention, and the spirit of the present invention is not limited by the embodiments.

The protective range of the present invention should be construed by the following claims and the scope and spirit of the invention should be construed as being included in the patent right of the present invention.

What is claimed is:

1. A refrigerator comprising:

a main body that includes an inner case including a storage chamber;

a refrigerating chamber discharge duct that divides the storage chamber into a heat exchange chamber and a refrigerating chamber and includes refrigerating chamber discharge holes for allowing cold air to pass between the heat exchange chamber and the refrigerating chamber;

a refrigerating chamber thermoelectric module including a first heat absorbing unit and a first heat dissipating unit, the first heat absorbing unit disposed in the heat exchange chamber for cooling the cold air;

a refrigerating chamber cooling fan to circulate the cold air in the refrigerating chamber to the heat exchange chamber and the refrigerating chamber;

a refrigerating chamber heat dissipating fan for blowing external air to the first heat dissipating unit;

a freezing compartment disposed in the refrigerating chamber and including a freezing chamber;

a freezing compartment thermoelectric module including a second heat absorbing unit and a second heat dissipating unit, the second heating dissipating unit for cooling the freezing chamber; and an air guide that forms a channel for guiding the cold air from the heat exchange chamber to the second heat dissipating unit, wherein the air guide is disposed over the refrigerating chamber discharge duct.

2. The refrigerator of claim 1, wherein the freezing compartment thermoelectric module is smaller in size than the refrigerating chamber thermoelectric module.

3. The refrigerator of claim 1, wherein the second heat absorbing unit is disposed in the freezing compartment, and the second heat dissipating unit is disposed between the freezing compartment and a rear of the inner case.

4. A refrigerator comprising:

a main body that includes an inner case including a storage chamber;

a refrigerating chamber discharge duct that divides the storage chamber into a heat exchange chamber and a refrigerating chamber and includes refrigerating chamber discharge holes for allowing cold air to pass between the heat exchange chamber and the refrigerating chamber;

a refrigerating chamber thermoelectric module including a first heat absorbing unit and a first heat dissipating unit, the first heat absorbing unit disposed in the heat exchange chamber for cooling the cold air;

a refrigerating chamber cooling fan to circulate the cold air in the refrigerating chamber to the heat exchange chamber and the refrigerating chamber;

a refrigerating chamber heat dissipating fan for blowing external air to the first heat dissipating unit;

a freezing compartment disposed in the refrigerating chamber and including a freezing chamber;

a freezing compartment thermoelectric module including a second heat absorbing unit and a second heat dissipating unit, the second heating dissipating unit for cooling the freezing chamber; and an air guide that forms a channel for guiding the cold air from the heat exchange chamber to the second heat dissipating unit, wherein the air guide includes an expanding portion disposed between an upper end of the refrigerating chamber discharge duct and the second heat dissipating unit.

5. A refrigerator comprising:

a main body that includes an inner case including a storage chamber;

a refrigerating chamber discharge duct that divides the storage chamber into a heat exchange chamber and a refrigerating chamber and includes refrigerating chamber discharge holes for allowing cold air to pass between the heat exchange chamber and the refrigerating chamber;

a refrigerating chamber thermoelectric module including a first heat absorbing unit and a first heat dissipating unit, the first heat absorbing unit disposed in the heat exchange chamber for cooling the cold air;

a refrigerating chamber cooling fan to circulate the cold air in the refrigerating chamber to the heat exchange chamber and the refrigerating chamber;

a refrigerating chamber heat dissipating fan for blowing external air to the first heat dissipating unit;

a freezing compartment disposed in the refrigerating chamber and including a freezing chamber;

a freezing compartment thermoelectric module including a second heat absorbing unit and a second heat dissipating unit, the second heating dissipating unit for cooling the freezing chamber; and an air guide that forms a channel for guiding the cold air from the heat exchange chamber to the second heat dissipating unit, the refrigerator further comprising a freezing compartment damper that controls the cold air flowing to the second heat dissipating unit through the channel of the air guide.

6. The refrigerator of claim 5, further comprising:

a freezing chamber cooling fan that circulates air in the freezing chamber to the second heat absorbing unit and the freezing chamber; and a freezing chamber heat dissipating fan that blows the cold air from the heat exchange chamber to the second heat dissipating unit.

7. The refrigerator of claim 6, further comprising a controller that controls the refrigerating chamber thermoelectric module, the freezing compartment thermoelectric module, the refrigerating chamber cooling fan, the refrigerating chamber heat dissipating fan, the freezing compartment damper, the freezing chamber cooling fan, and the freezing chamber heat dissipating fan.

8. The refrigerator of claim 7, wherein the controller applies low voltage to at least one of the refrigerating chamber thermoelectric module and the freezing compartment thermoelectric module when the freezing compartment is in a high-temperature cooling mode, and applies high voltage to at least one of the refrigerating chamber thermoelectric module and the freezing compartment thermoelectric module when the freezing compartment is in a low-temperature cooling mode.

9. The refrigerator of claim 8, wherein the controller rotates at least one of the freezing chamber cooling fan and the freezing chamber heat dissipating fan at low revolution per minute (RPM) when the freezing compartment is in the high-temperature cooling mode, and rotates at least one of the freezing chamber cooling fan and the freezing chamber heat dissipating fan at high RPM when freezing compartment is in the low-temperature cooling mode.

10. The refrigerator of claim 7, wherein the controller performs a simultaneous operation that drives the refrigerating chamber thermoelectric module, the refrigerating chamber cooling fan, the refrigerating chamber heat dissipating fan, the freezing compartment thermoelectric module, the freezing chamber cooling fan, and the freezing chamber heat dissipating fan, and opens the freezing compartment damper.

11. The refrigerator of claim 7, wherein the controller performs an exclusive freezing compartment operation that drives the freezing compartment thermoelectric module, the freezing chamber cooling fan, and the freezing chamber heat dissipating fan, and opens the freezing compartment damper.

12. The refrigerator of claim 7, wherein the controller performs an exclusive refrigerating chamber operation that drives the refrigerating chamber thermoelectric module, the refrigerating chamber cooling fan, and the refrigerating chamber heat dissipating fan, stops the freezing compartment thermoelectric module, the freezing chamber cooling fan, and the freezing chamber heat dissipating fan, and closes the freezing compartment damper.

13. The refrigerator of claim 7, wherein the controller performs an exclusive refrigerating chamber defrosting operation that turns off the refrigerating chamber thermoelectric module and drives the refrigerating chamber cooling fan and the refrigerating chamber heat dissipating fan.

14. The refrigerator of claim 13, wherein the controller opens the freezing compartment damper.

15. The refrigerator of claim 13, wherein the controller performs a simultaneous defrosting operation that drives the refrigerating chamber cooling fan and performs inverse voltage control on the freezing compartment thermoelectric module with the refrigerating chamber thermoelectric module off, when a refrigerating chamber temperature is higher by a set temperature than a refrigerating chamber target temperature during the exclusive refrigerating chamber defrosting operation.

16. The refrigerator of claim 15, wherein the controller opens the freezing compartment damper.

17. The refrigerator of claim 7, wherein the controller performs a simultaneous defrosting operation that turns off the refrigerating chamber thermoelectric module, drives the refrigerating chamber cooling fan, and performs inverse voltage control on the freezing compartment thermoelectric module.

18. The refrigerator of claim 17, wherein the controller closes the freezing compartment damper.

* * * * *